US010005525B2

(12) United States Patent
Pendle

(10) Patent No.: US 10,005,525 B2
(45) Date of Patent: Jun. 26, 2018

(54) SURFBOARDS

(71) Applicant: Matthew Pendle, Black River (MU)

(72) Inventor: Matthew Pendle, Black River (MU)

( * ) Notice: Subject to any disclaimer, the term of this patent is extended or adjusted under 35 U.S.C. 154(b) by 0 days. days.

(21) Appl. No.: 14/894,260

(22) PCT Filed: May 15, 2014

(86) PCT No.: PCT/GB2014/051491
§ 371 (c)(1),
(2) Date: Nov. 25, 2015

(87) PCT Pub. No.: WO2014/191717
PCT Pub. Date: Dec. 4, 2014

(65) Prior Publication Data

US 2016/0114866 A1 Apr. 28, 2016

(30) Foreign Application Priority Data

May 29, 2013 (GB) ..... 1309597.1

(51) Int. Cl.
*B63B 35/79* (2006.01)

(52) U.S. Cl.
CPC ..... *B63B 35/7913* (2013.01); *B63B 35/7906* (2013.01); *B63B 35/7916* (2013.01); *B63B 35/7933* (2013.01); *B63B 35/7946* (2013.01)

(58) Field of Classification Search
CPC ..... B63B 35/7913; B63B 35/7946; B63B 35/7933; B63B 35/7916; B63B 35/7906
USPC ..... 441/74
See application file for complete search history.

(56) References Cited

U.S. PATENT DOCUMENTS

| | | | | |
|---|---|---|---|---|
| 3,657,753 | A | 4/1972 | Le Blanc, Sr. | |
| 5,148,761 | A * | 9/1992 | Winner | B63B 35/7926 114/39.15 |
| 5,351,637 | A * | 10/1994 | Brenckmann | B63B 35/7913 114/39.14 |
| 7,662,006 | B2 * | 2/2010 | Mollis | B63B 35/7913 114/357 |
| 8,821,204 | B1 * | 9/2014 | Hoge, Jr. | B63B 35/7913 441/66 |
| 2014/0080369 | A1 * | 3/2014 | Haller | B63B 35/79 441/66 |

FOREIGN PATENT DOCUMENTS

| | | |
|---|---|---|
| DE | 3130565 | 2/1983 |
| DE | 3336898 | 4/1985 |
| WO | WO92/19491 | 11/1992 |

* cited by examiner

*Primary Examiner* — Anthony D Wiest
(74) *Attorney, Agent, or Firm* — Seed Intellectual Property Law Group LLP

(57) ABSTRACT

A surfboard, the rear part 1 of which is rigid and equipped for example with one or more fin boxes and other accessories such as foot strap inserts, leash inserts and or a mast box, the front part 2 of which is inflatable and equipped with a valve which permits the said inflatable part to be inflated for use and deflated after use to facilitate transport and storage.

14 Claims, 5 Drawing Sheets

SURFBOARDS

CROSS-REFERENCE TO RELATED APPLICATIONS

This application claims priority to Great Britain Application No. PCT/GB2014/051491, filed May 15, 2014, Great Britain Priority Application No. 1309597.1, filed May 29, 2013. All of the above applications are incorporated by reference in their entirety.

FIELD OF THE INVENTION

This invention relates to surfboards.

It is to be noted that the term "surfboard" as used herein is intended to refer to any of the various different types of surfboards existing, including stand up paddle surfboards and windsurf boards.

BACKGROUND

Rigid surfboards are manufactured from materials such as hard setting resins and closed cell rigid foam which makes it possible to produce a completely rigid surfboard with a shape that offers optimum performance. Rigid surfboards have the disadvantage of being difficult to transport and to store due to their size and the fact that they cannot be collapsed.

Inflatable surfboards have the advantage of being easy to transport and to store due to the fact that they can be deflated. However they have the disadvantage of having a poorer performance than rigid surfboards due to the fact that their method of production using flexible materials prevents them from having sufficient rigidity and a shape that offers optimum performance.

When considering surfboards, the problem of how to reconcile performance with convenience of transport and storage, has existed for years. Conventional, rigid surfboards, which can be long and very cumbersome, have emphasized this problem. This led to the introduction of inflatable stand up paddle surfboards.

However, the problem regarding the performance of inflatable surfboards is that their shape changes during use due to the weight of the user and the action of for example waves. This is due to their inherent flexibility, which also means that they cannot be produced with a suitable high performance profile, such as those found in rigid surfboards.

Various modifications to rigid surfboards have been proposed to make them easier to store and transport, including the concepts illustrated in US 20130029547 A1 and WO 2009070825 A1.

US 20130029547 A1 for example proposes cutting a conventional rigid surfboard in half and connecting the two halves when in use, so providing a surfboard that is relatively easy to transport while still retaining a relatively high level of performance.

WO 2009070825 A1 proposes cutting the surfboard into sections and hinging the sections together.

With regards to inflatable surfboards, various proposals to improve their performance have been made, including the use of stiffening plates and other devices attached to the surface of the inflatable structure as seen for example in U.S. Pat. No. 3,657,753, WO2013175160 and U.S. Pat. No. 7,662,006.

U.S. Pat. No. 3,657,753 describes a folding inflatable surfboard.

WO2013175160 proposes attaching stiffeners to the side of the inflatable surfboard.

Another question that arises in connection with inflatable surfboards is how to attach fins to their underside. Today it is usual for inflatable stand up surfboards to be equipped with fins inserted into rigid fin box supports attached to the underside surface of the end of the inflatable surfboard.

U.S. Pat. No. 7,662,006 describes an example of an inflatable surfboard in which the fin box supports are incorporated into a rigid fin box support structure that takes the form of a plate that is attached to the underneath surface of the inflatable surfboard and extends to the edge of the rear part of the inflatable surfboard. The edge of the plate is coincident with the edge of the board, so helps to give a better edge to the rail. However, the principal idea described in this patent is a system for constructing an inflatable surfboard by using moulds formed from conventional rigid surfboards to produce flexible inflatable surfboards that have a better shape than a conventional inflatable surfboard together with the advantage of being collapsible and so easy to store and to transport.

SUMMARY OF INVENTION

A general aim of the present invention is to offer a surfboard that can be easily stored and transported without compromising performance.

In general, the invention proposes a surfboard which is partly rigid and partly inflatable. That is to say, a portion of the board (e.g. a tail portion) is a rigid (non-inflatable) structure (that extends to the full thickness of the board) and another portion of the board (e.g. a mid-portion and/or a nose portion) is inflatable and can be collapsed and/or allows the board to fold when deflated to reduce the overall size of the board, which is advantageous for transport and storage.

Accordingly, the invention provides a surfboard which is partly rigid and partly inflatable the rear part of which is made of rigid materials and the inflatable part being made of flexible materials and equipped with a valve by means of which the inflatable part of the surfboard can be inflated when in use and deflated when not in use to facilitate transport and storage.

With this construction, surfboards in accordance with embodiments of the invention give the relatively high performance associated with a rigid board and at the same time partly offer the transport and storage advantages associated with inflatable boards.

In some embodiments the rigid rear part is shorter than the inflatable front part.

In other embodiments the rigid rear part is longer than the inflatable front part. This may be beneficial, for example, for boards intended for use as windsurf boards as it becomes possible to incorporate an appropriately located mast box into the rigid portion of the board.

The surfboard may incorporate one or more fin or foil boxes, one or more foot strap inserts, one or more leash inserts and/or a mast box.

Surfboards in accordance with embodiments of the invention may be designed for use as a conventional surfboard (e.g. short board, long board, kite surfboard etc), as a stand-up paddle surfboard or as a windsurf board.

In some embodiments, the surfboard also includes a rigid front part attached to the front of the inflatable part. Where the board includes rigid rear and front parts, it may further comprise one or more detachable stiffening elements that, when the board is inflated, can span across the inflated section from one rigid section to the other, adding to the overall rigidity of the board in use.

BRIEF DESCRIPTION OF FIGURES

Embodiments of the invention will now be described by way of example with reference to the accompanying drawings in which.

DESCRIPTION OF EMBODIMENTS

Several examples of surfboards in accordance with embodiments of the invention are described below and illustrated in the figures, each having one (or more) rigid parts and an inflatable part. In the accompanying drawings the rigid parts of the surfboard are generally represented using thick lines in contrast to the inflatable parts of the surfboard which are generally represented using thin lines.

A first exemplary surfboard in accordance with an embodiment of the invention is described with reference to FIGS. 1 to 4 and would be typically applied for example to surfboards and to stand up paddle surfboards. In this example, the rear part 1 of the board is rigid and the front part 2 of the board is flexible and inflatable. In this example the rigid rear part of the surfboard is shorter than the front flexible, inflatable part of the surfboard.

Figure 1:
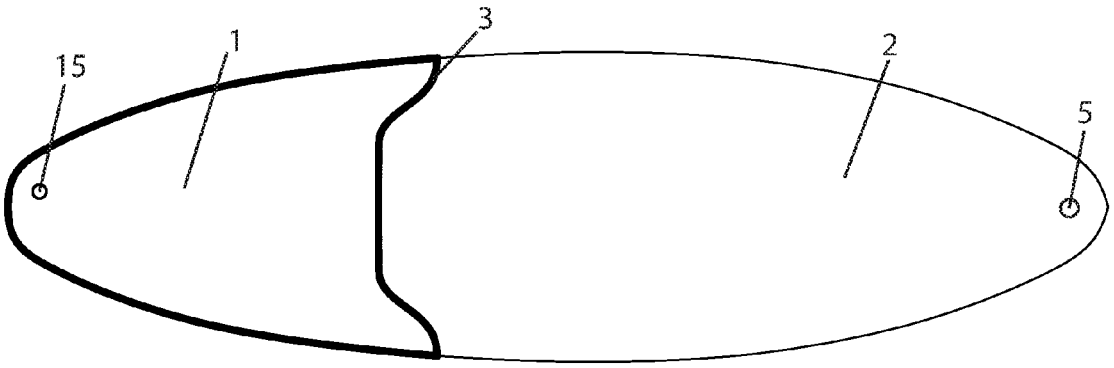
FIG. 1 is a plan view of a surfboard in accordance with a first embodiment of the present invention.
Figure 2:
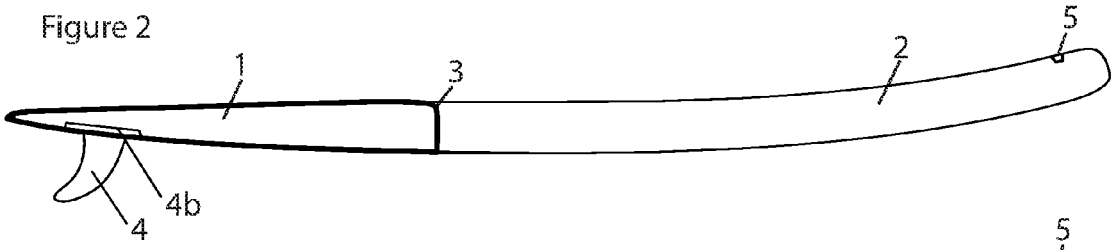
FIG. 2 is a side view of the surfboard of FIG. 1.
Figure 3:
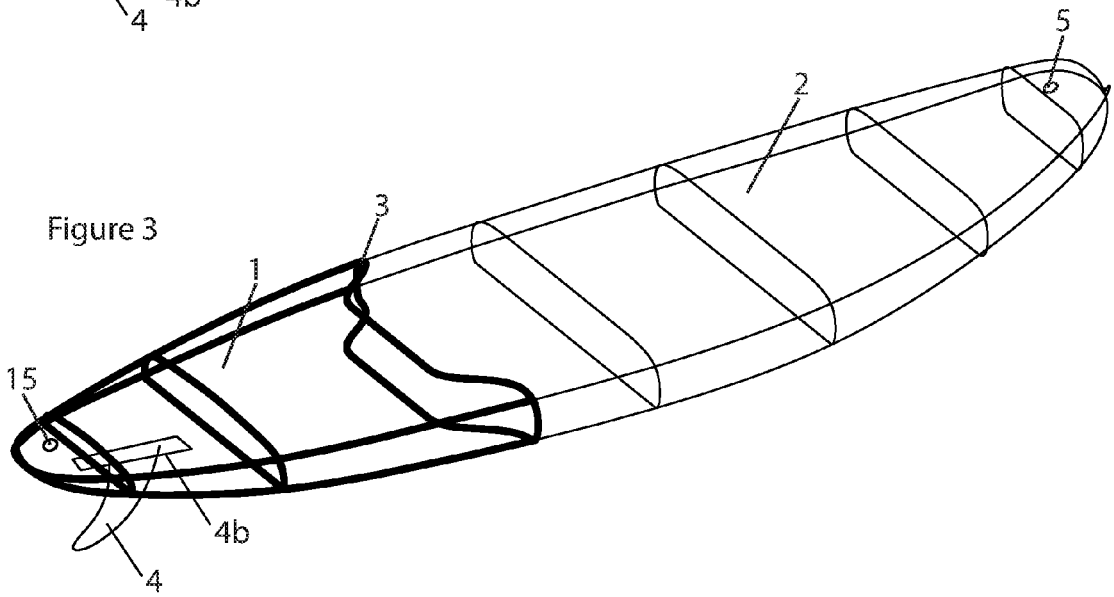
FIG. 3 is a ¾ perspective view of the surfboard of FIG. 1.
Figure 4:
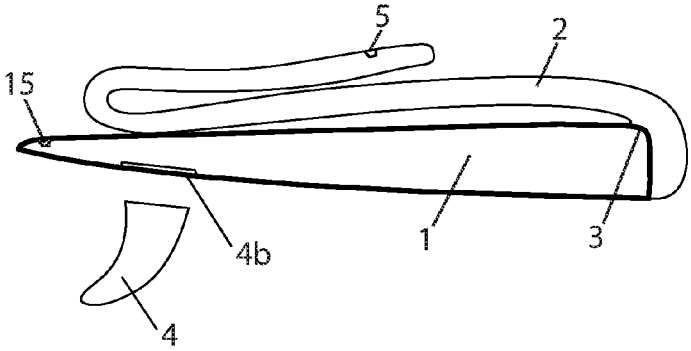
FIG. 4 shows the surfboard of FIG. 1 in a configuration in which the front of the surfboard is deflated and folded in order to facilitate transport and storage.
Figure 5:
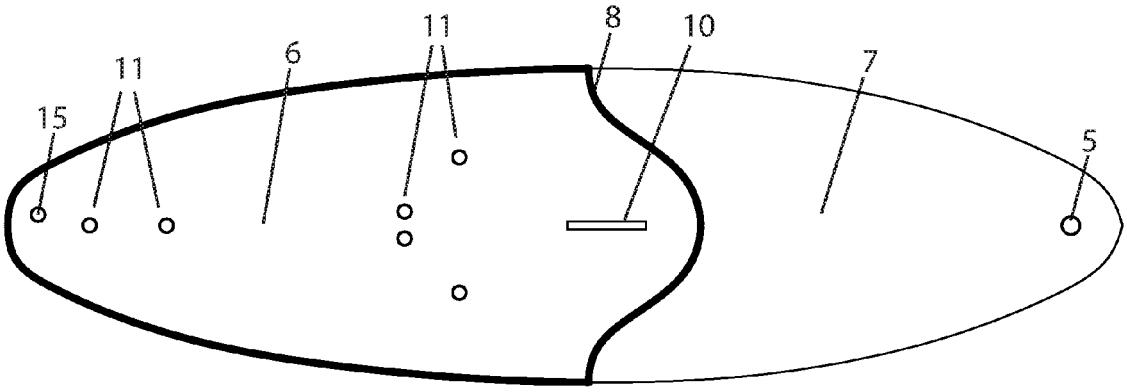
FIG. 5 is a plan view of a surfboard in accordance with a second embodiment of the invention.
Figure 6:
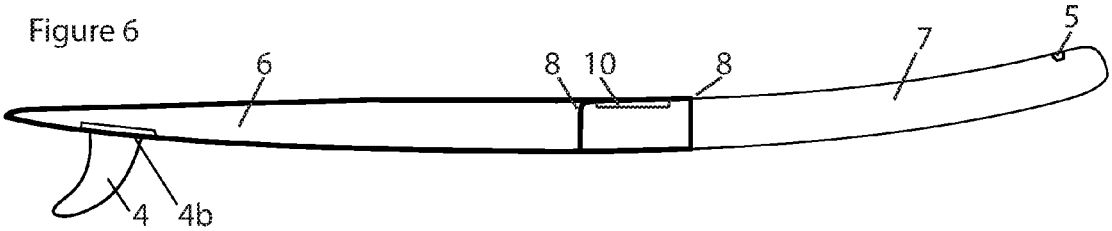
FIG. 6 is a side view of the surfboard of FIG. 5.
Figure 7:
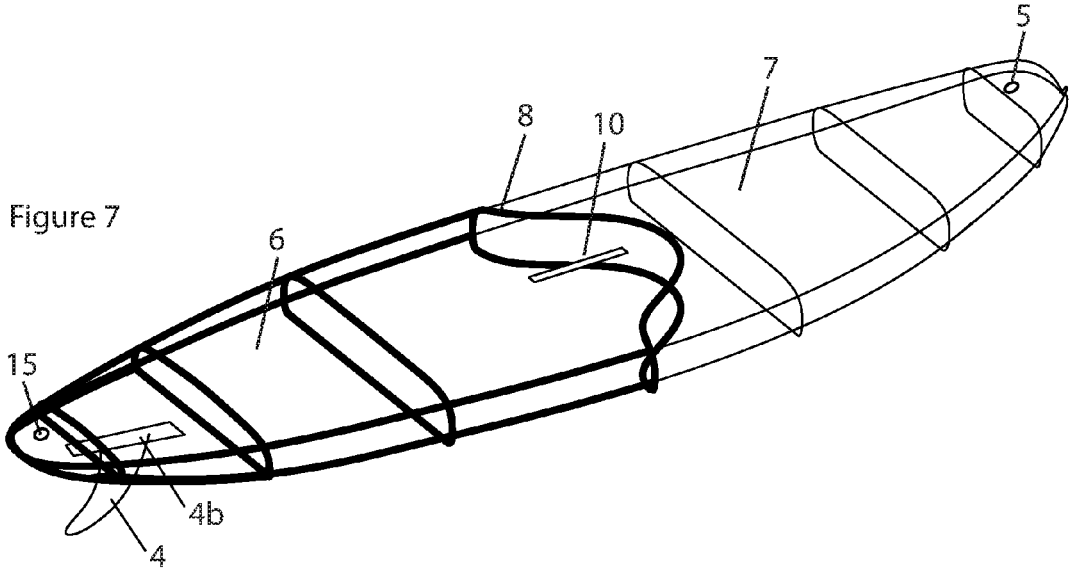
FIG. 7 is a ¾ perspective view of the surfboard of FIG. 5.

The rear part 1 of the surfboard is fabricated using for example epoxy resin, fiberglass, expanded rigid closed cell foam, (e.g. polyurethane and polystyrene) and other materials currently used in the fabrication of rigid surfboards and the front end 2 of the surfboard is fabricated using a flexible material as is currently used in the manufacture of inflatable surfboards using for example drop stitch technology. The rigid rear end 1 of the surfboard is attached at the joining line 3 to the front flexible inflatable part 2 of the surfboard by means of gluing or any other suitable known method. A leash insert 15 together with a fin box 4*b* and a fin 4 are located on the rear rigid part 1 of the surfboard. The flexible inflatable front part 2 of the surfboard is inflated for use by means of a valve 5. According to the invention when the surfboard is not in use the front part 2 of the surfboard can be deflated and folded to facilitate transport and storage of the board as illustrated in FIG. 4.

Figure 8:
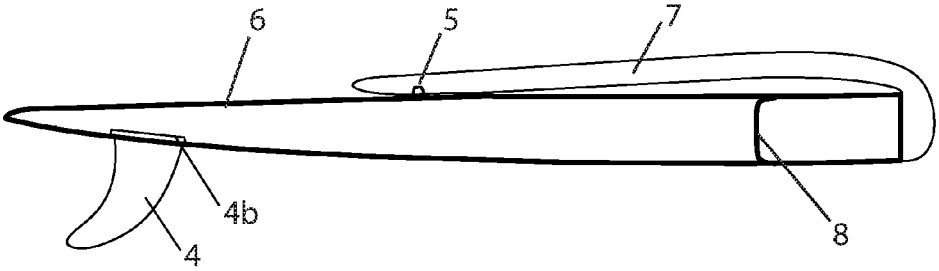
FIG. 8 shows the surfboard of FIG. 5 in a configuration in which an inflatable front of the surfboard is deflated and folded to facilitate transport and storage.

FIGS. 5 to 8 illustrate another example of a surfboard in accordance with an embodiment of the present invention, having a rigid rear part 6 and an inflatable front part 7 that are joined to one another at a joining line 8. The length of the rigid rear part 6 of the surfboard is greater than the length of the inflatable front part 7 of the surfboard. In addition to the incorporation of a fin box 4*b* and a fin 4, a mast box 10 and foot strap inserts 11 are incorporated into the rigid rear part 6 of the surfboard in the case for example of the present invention being applied to windsurf boards. The inflatable front part 7 is inflated by means of a valve 5. According to the invention when the surfboard is not in use the front inflatable part 7 of the surfboard can be deflated and folded to facilitate transport and storage of the board as illustrated in FIG. 8.

Figure 9:
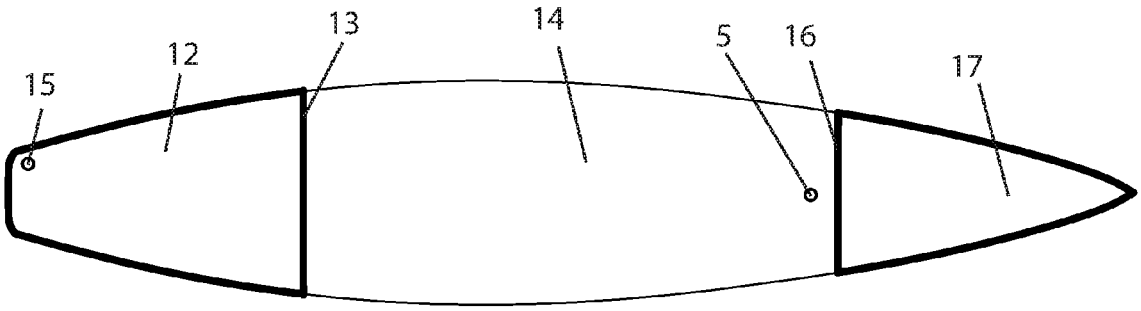
FIG. 9 is a plan view of a surfboard in accordance with a third embodiment of the invention.
Figure 10:
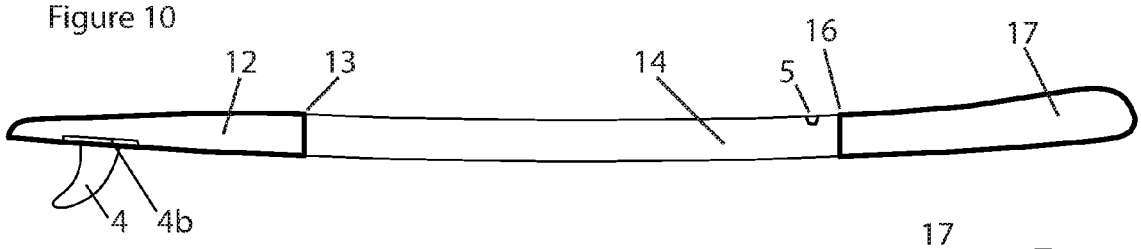
FIG. 10 is a side view of the surfboard of FIG. 9.
Figure 11:
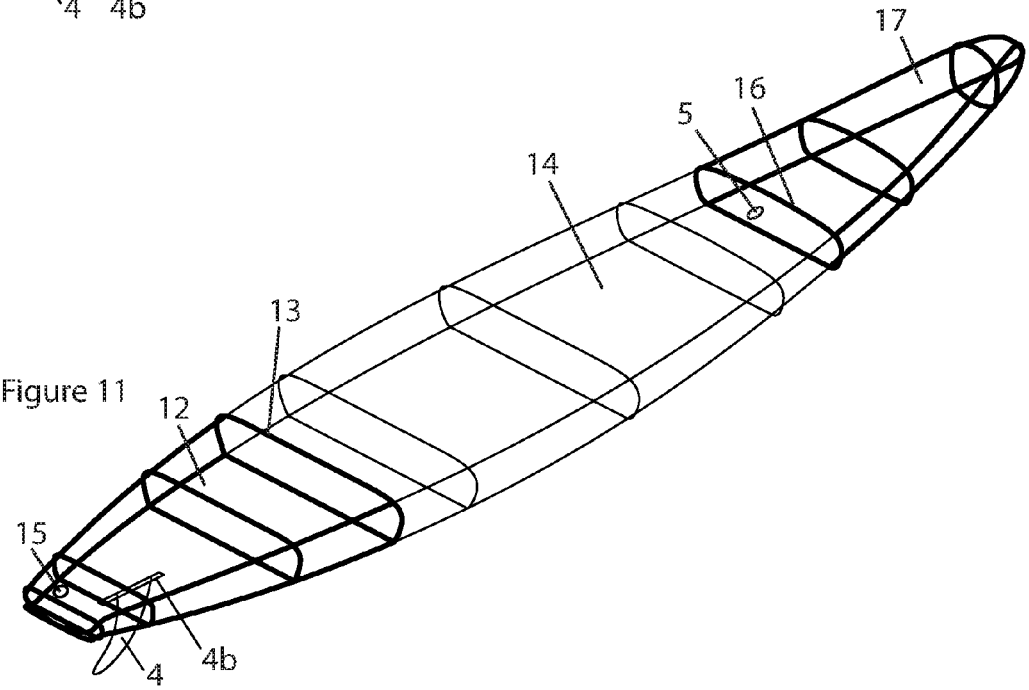
FIG. 11 is a ¾ perspective view of the surfboard of FIG. 9.
Figure 12:
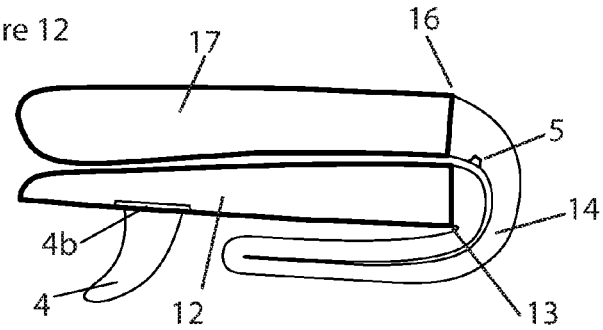
FIG. 12 shows the surfboard of FIG. 9 in a configuration in which an inflatable middle part of the surfboard is deflated and folded to facilitate transport and storage.

FIGS. 9, 10 and 11 illustrate another example of a surfboard in accordance with an embodiment of the present invention. In this example a rear rigid part and a front rigid part are connected by a middle inflatable part. Specifically, two relatively short rigid rear and front parts 12 and 17 of a surfboard are joined to a relatively long flexible inflatable part 14 at join lines 13 and 16. FIG. 12 represents the surfboard illustrated in FIGS. 9, 10 and 11 in which the inflatable middle part is deflated and folded to facilitate transport and storage of the board.

Figure 13:
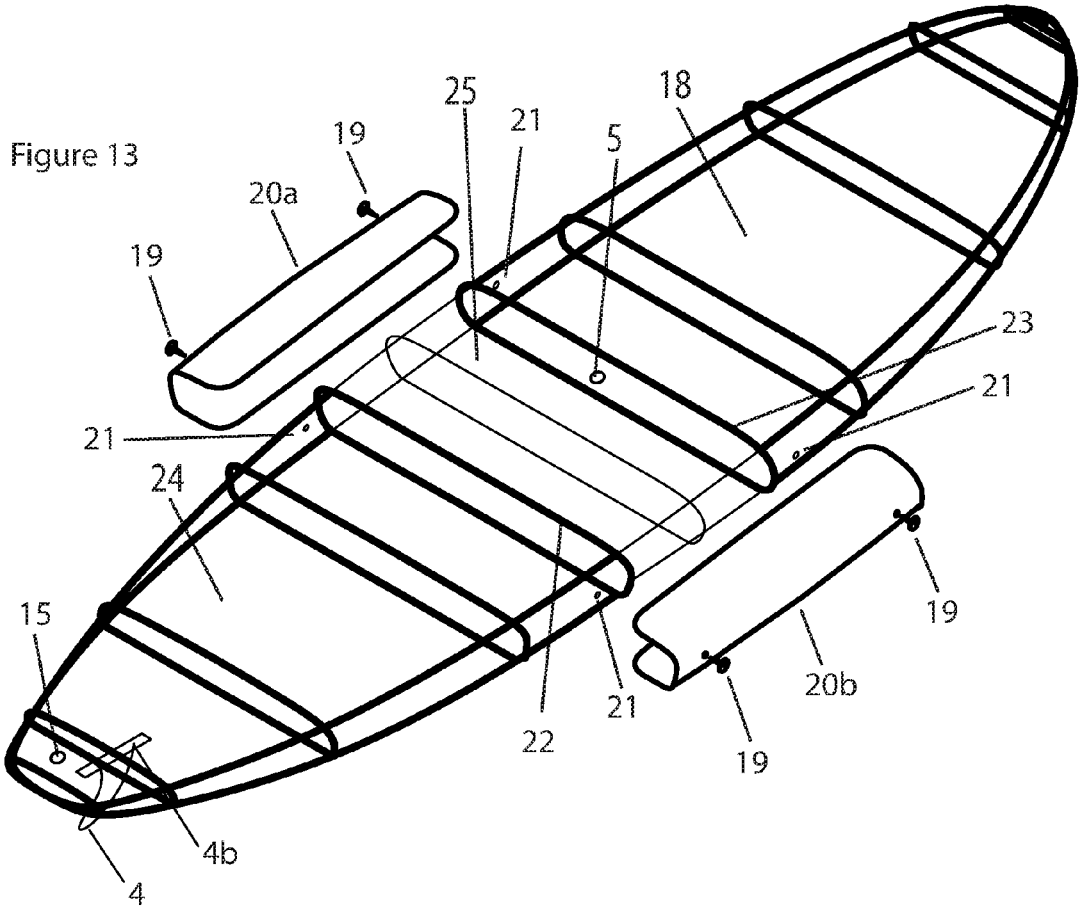
FIG. 13 is a plan view of a surfboard in accordance with a fourth embodiment of the invention.
Figure 14:
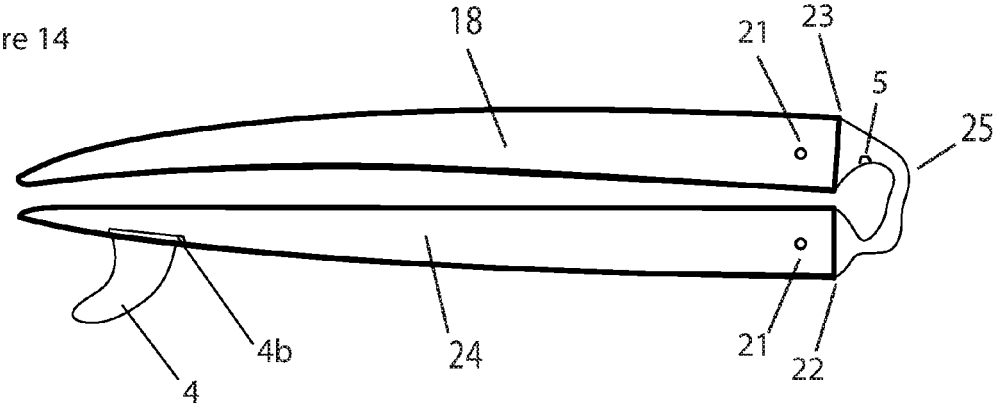
FIG. 14 shows the surfboard of FIG. 13 in a configuration in which an inflatable middle part of the surfboard is deflated and folded to facilitate transport and storage.

FIG. 13 illustrates another example of a surfboard in accordance with an embodiment of the invention in which rigid rear and front parts are connected by an inflatable middle part. In this example two relatively long rigid parts 24 and 18 of a surfboard are joined to a relatively short middle flexible inflatable part 25 at join lines 22 and 23. Stiffeners 20*a* and 20*b* may be attached to the sides of the surfboard by means of screws 19 and screw inserts 21, or by any suitable known method, to stiffen the surfboard when in use. The stiffeners can be removed after use when the inflatable middle part of the surfboard is deflated to facilitate transport and storage of the board as illustrated in FIG. 14.

Figure 15:
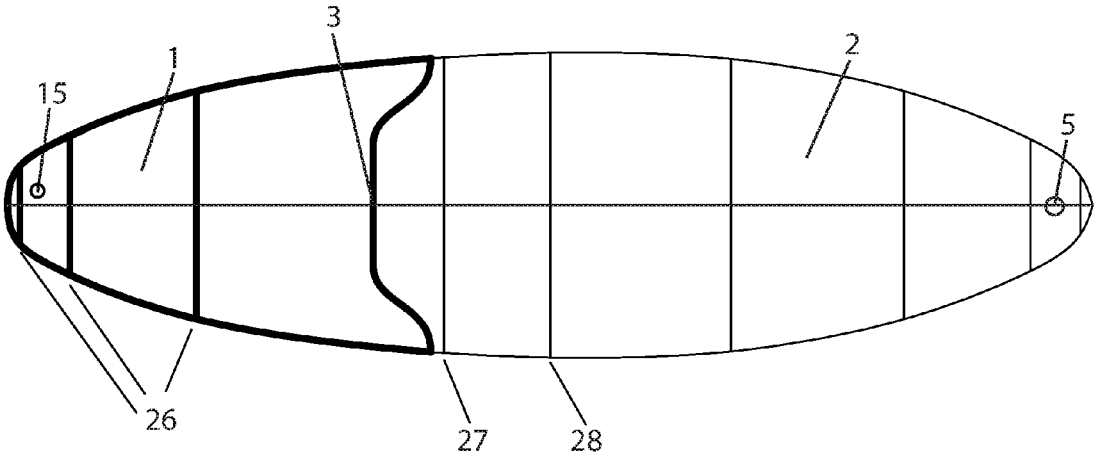
FIGS. 15 and 16 show examples of different types of profile that can be given to the rigid part of a surfboard together with the typically rounded profiles of the flexible inflatable part of a surfboard, for example as shown in FIG. 1 to 4, 5 to 8, 9 to 11 or 13 to 14.
Figure 16:
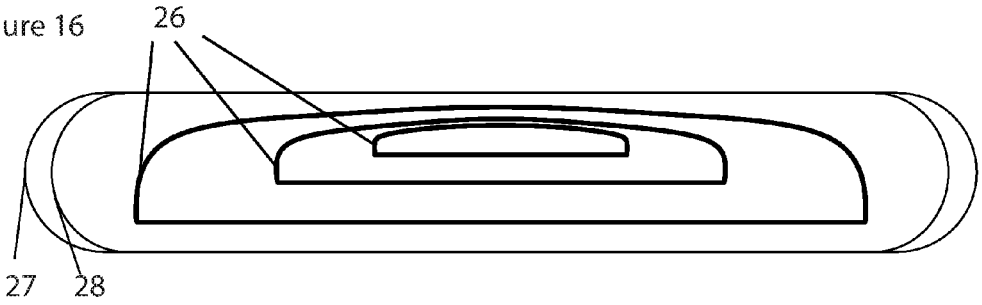

In FIGS. 15 and 16 the cross sections 26 illustrate the sharp angular type of profile that can be obtained using standard fabrication techniques used for the manufacture of rigid surfboards and the cross sections 27 and 28 illustrate the typically rounded profiles which are common to inflatable surfboards.

Figure 17:
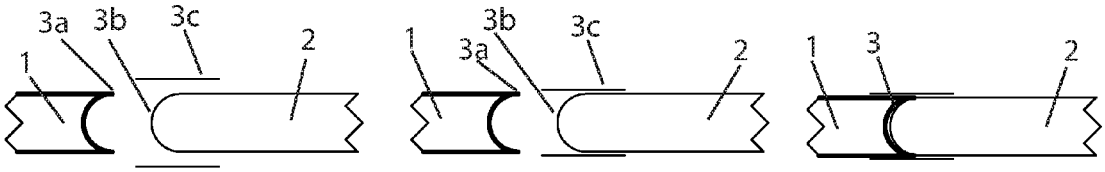
FIGS. 17 and 18 show examples of connections between a rigid part of a surfboard and a flexible inflatable part of a surfboard that can be used in embodiments of the present invention.

FIG. 17 represents an example of a technique for attaching a rigid part of a surfboard 1 to a flexible inflatable part of a surfboard 2 where the end 3*a* of the rigid part 1 of the surfboard is concave and where the end 3*b* of the flexible inflatable part 2 is convex. A flexible sleeve 3*c* is glued to the flexible inflatable part 2, the convex end of the inflatable part 2 together with the sleeve 3*c* is then glued to the end 3*a* of the rigid part 1 of the surfboard to form a permanent joint 3.

Figure 18:
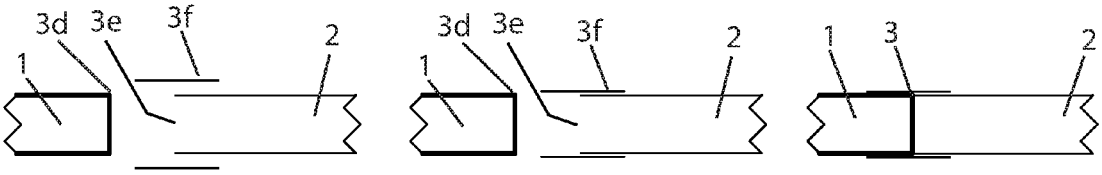

FIG. 18 represents another example of a technique for attaching a rigid part 1 of a surfboard to a flexible inflatable part 2 of a surfboard where the end 3*d* of the rigid part 1 of the surfboard is straight and where the end 3*e* of the flexible inflatable part 2 of the surfboard is open. The flexible sleeve 3*f* is glued to the flexible inflatable part 2, which is then glued to the end 3*d* of the rigid part 1 of the surfboard to form a permanent joint 3.

It is to be noted that according to the present invention the techniques illustrated in FIGS. 17 and 18 for attaching a rigid part of a surfboard to a flexible inflatable part of a surfboard are examples and that these methods may be replaced by any other suitable known technique.

The invention claimed is:

1. A surfboard which is partly rigid and partly inflatable, the surfboard comprising:

a rigid rear part which is made of rigid materials; and an inflatable part made of flexible materials and equipped with a valve by means of which the inflatable part of the surfboard can be inflated when in use and deflated when not in use to facilitate transport and storage;

wherein a rear end of the inflatable part of the surfboard is attached to a front end of the rigid rear part of the surfboard with a flexible sleeve over a joint between the front end of the rigid rear part and the rear end of the inflatable part, the sleeve being glued to the inflatable part and the rigid rear part of the surfboard and forming a permanent joint, the sleeve covering only a portion of the rigid rear part adjacent the joint and only a portion of the inflatable part adjacent the joint.

2. A surfboard according to claim 1, wherein the rigid rear part is shorter than the inflatable part.

3. A surfboard according to claim 1, wherein the rigid rear part is longer than the inflatable part.

4. A surfboard according to claim 1, further comprising one or more fin boxes.

5. A surfboard according to claim 1, further comprising one or more foot strap inserts.

6. A surfboard according to claim 1, further comprising one or more leash inserts.

7. A surfboard according to claim 1, further comprising a mast box.

8. A surfboard according to claim 1, wherein the surfboard is a stand-up paddle surfboard.

9. A surfboard according to claim 1, wherein the surfboard is a windsurf board.

10. A surfboard according to claim 1, wherein a rigid front part is attached to a front of the inflatable part, the rigid front part being a non-inflatable structure that extends to a full thickness of the board.

11. A surfboard according to claim 10, wherein stiffeners are attached to the rigid rear part and the rigid front part of the surfboard to stiffen the surfboard during use.

12. A surfboard according to claim 11, wherein the stiffeners span across the inflated part of the surfboard from the rear rigid section to the front rigid section.

13. A surfboard according to claim 11, wherein the stiffeners are detachable from one or both of the rigid parts.

14. A surfboard which is partly rigid and partly inflatable, the surfboard comprising:

a rigid rear part which is made of rigid materials; and an inflatable part made of flexible materials and equipped with a valve by means of which the inflatable part of the surfboard can be inflated when in use and deflated when not in use to facilitate transport and storage;

wherein a rear end of the inflatable part of the surfboard is attached to a front end of the rigid rear part of the surfboard with a flexible sleeve over a joint between the front end of the rigid rear part and the rear end of the inflatable part, the sleeve being glued to the inflatable part and the rigid rear part of the surfboard, the sleeve covering only a portion of the rigid rear part adjacent the joint and only portion of the inflatable part adjacent the joint, a cross-section of a thickness of the rear end of the inflatable part having a convex shape and a cross-section of a thickness of the front end of the rigid part having a corresponding concave shape.

* * * * *